US010597848B1

(12) United States Patent
Finch

(10) Patent No.: US 10,597,848 B1
(45) Date of Patent: Mar. 24, 2020

(54) BULLDOZER RAKE ASSEMBLY

(71) Applicant: Thomas Glenn Finch, Willow Springs, NC (US)

(72) Inventor: Thomas Glenn Finch, Willow Springs, NC (US)

( * ) Notice: Subject to any disclaimer, the term of this patent is extended or adjusted under 35 U.S.C. 154(b) by 0 days.

(21) Appl. No.: 16/155,284

(22) Filed: Oct. 9, 2018

(51) Int. Cl.
*E02F 3/76* (2006.01)
*E02F 3/815* (2006.01)
*E02F 3/96* (2006.01)

(52) U.S. Cl.
CPC ..... *E02F 3/8152* (2013.01); *E02F 3/962* (2013.01)

(58) Field of Classification Search
CPC ..... E02F 3/815; E02F 3/8152; E02F 3/962
USPC ..... 172/815, 817
See application file for complete search history.

(56) References Cited

U.S. PATENT DOCUMENTS 2,473,505 A * 6/1949 Brock ..... E02F 3/962 414/724
2,840,936 A * 7/1958 Rand ..... E02F 3/8152 172/777
2,852,875 A * 9/1958 Bierwith ..... E02F 3/8152 172/777
2,950,551 A * 8/1960 Pesce ..... E02F 3/8152 37/301
3,034,237 A * 5/1962 Wolfe ..... E02F 3/769 37/405
3,421,642 A * 1/1969 Carter ..... E02F 3/46 414/724
3,458,069 A * 7/1969 Sturn, Jr. ..... B66F 9/12 414/722
4,422,819 A * 12/1983 Guest ..... E02F 3/401 37/406
5,111,599 A 5/1992 DeSalvo
5,333,693 A 8/1994 Severeid
5,664,348 A 9/1997 Omann
5,901,477 A 5/1999 Weaver
6,092,606 A 7/2000 Basler
6,401,831 B2 6/2002 Bouchard
D742,425 S 11/2015 May

* cited by examiner

*Primary Examiner* — Tara Mayo-Pinnock

(57) ABSTRACT

A bulldozer rake assembly for facilitating a single bulldozer blade to be employed for grubbing and grading includes a bulldozer blade that is mountable on a bulldozer for grading. The bulldozer blade has a bottom edge and a top edge. A rake unit is pivotally coupled to the bulldozer blade. The rake unit is positionable in a deployed position having the rake unit being aligned with the bottom edge of the bulldozer blade. In this way the rake unit is positioned to engage roots and debris for grubbing. The rake unit is positionable in a stored position having the rake unit being aligned with the top edge of the bulldozer blade. In this way the bulldozer blade can engage earth for grading.

6 Claims, 5 Drawing Sheets

BULLDOZER RAKE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to rake devices and more particularly pertains to a new rake device for facilitating a single bulldozer blade to be employed for both grubbing and grading.

BRIEF SUMMARY OF THE INVENTION

An embodiment of the disclosure meets the needs presented above by generally comprising a bulldozer blade that is mountable on a bulldozer for grading. the bulldozer blade has a bottom edge and a top edge. A rake unit is pivotally coupled to the bulldozer blade. The rake unit is positionable in a deployed position having the rake unit being aligned with the bottom edge of the bulldozer blade. In this way the rake unit is positioned to engage roots and debris for grubbing. The rake unit is positionable in a stored position having the rake unit being aligned with the top edge of the bulldozer blade. In this way the bulldozer blade can engage earth for grading.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
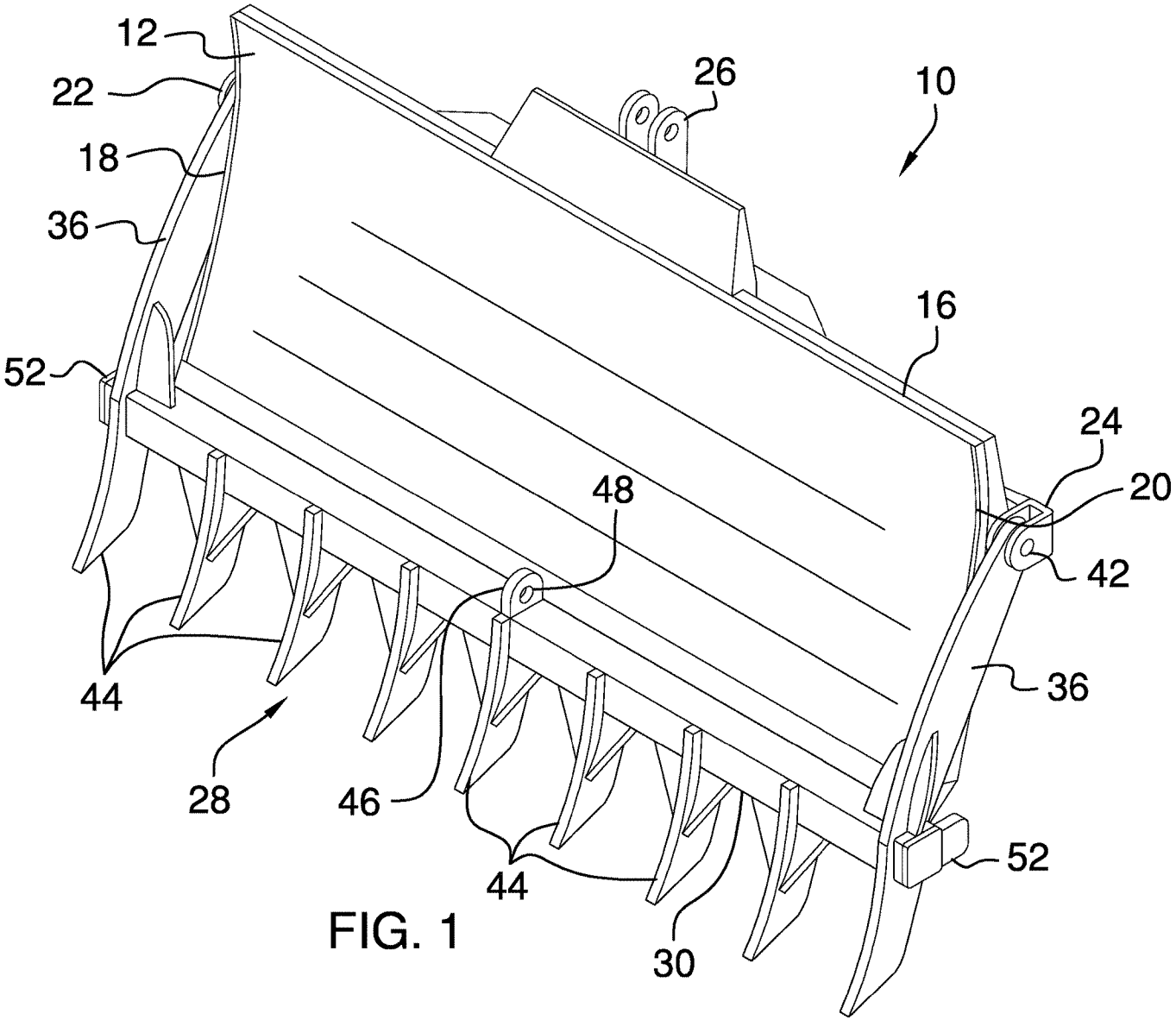
FIG. 1 is a front perspective view of a bulldozer rake assembly according to an embodiment of the disclosure.
Figure 3:
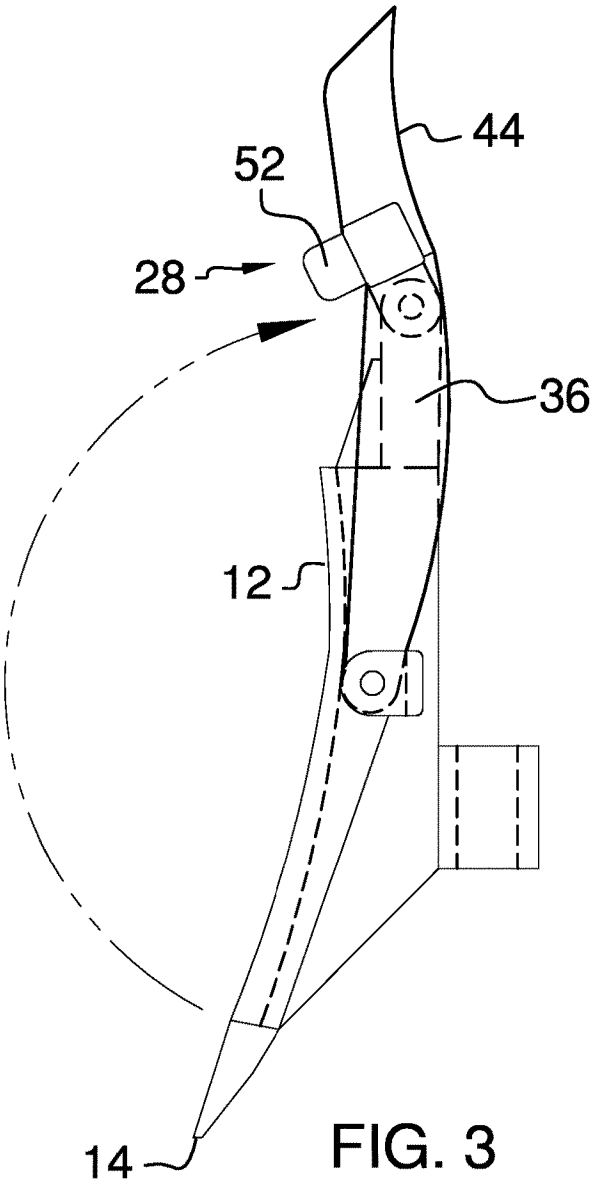
FIG. 3 is a left side phantom view of an embodiment of the disclosure showing a rake unit in a stored position.
Figure 2:
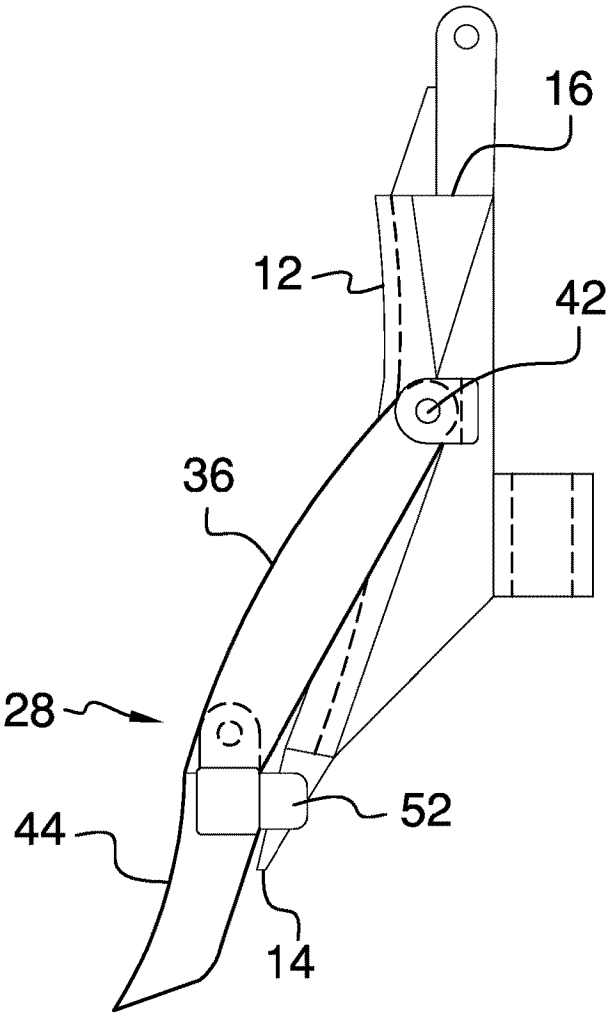
FIG. 2 is a left side phantom view of an embodiment of the disclosure showing a rake unit in a deployed position.
Figure 4:
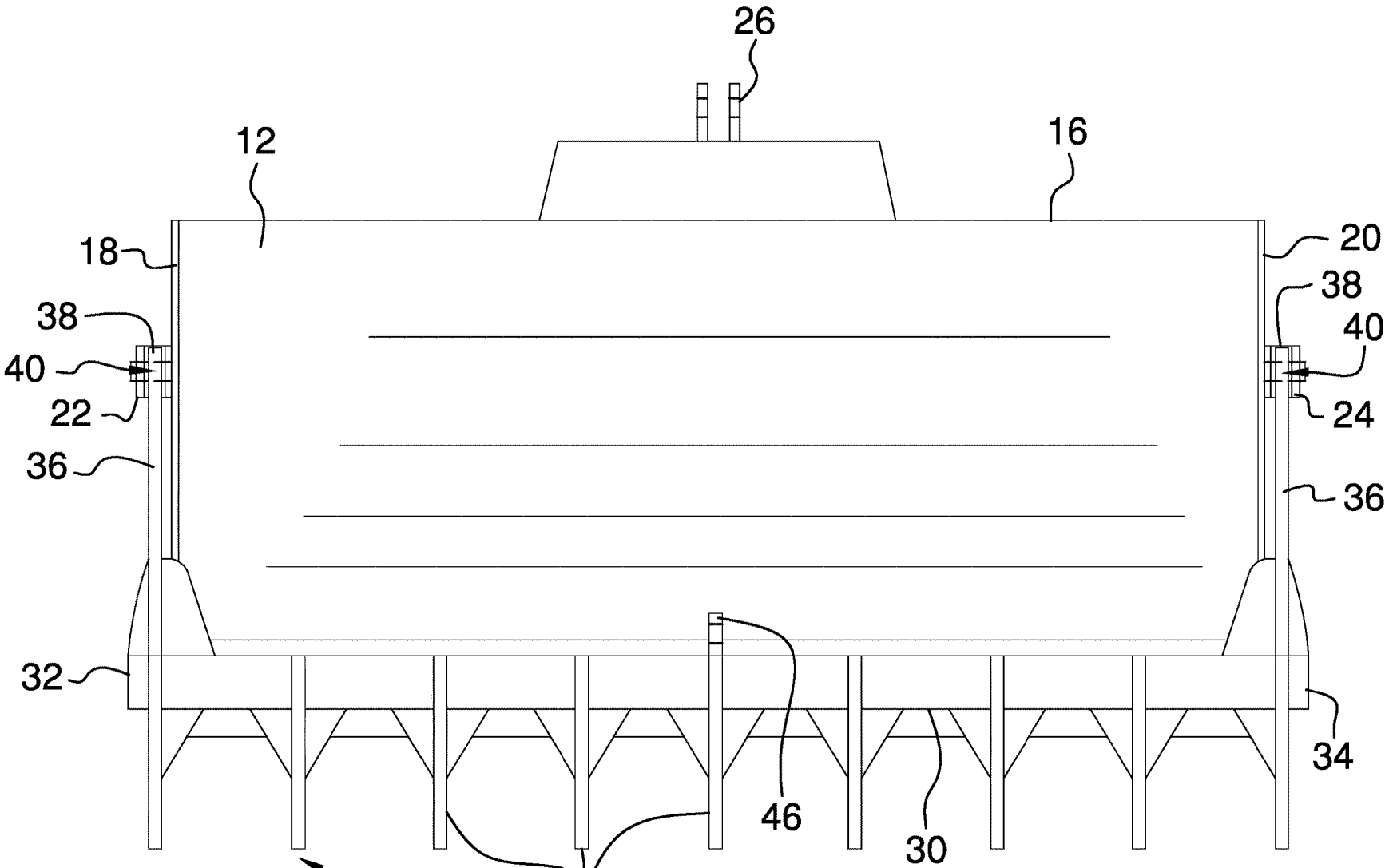
FIG. 4 is a front view of an embodiment of the disclosure showing a rake unit in a deployed position.
Figure 5:
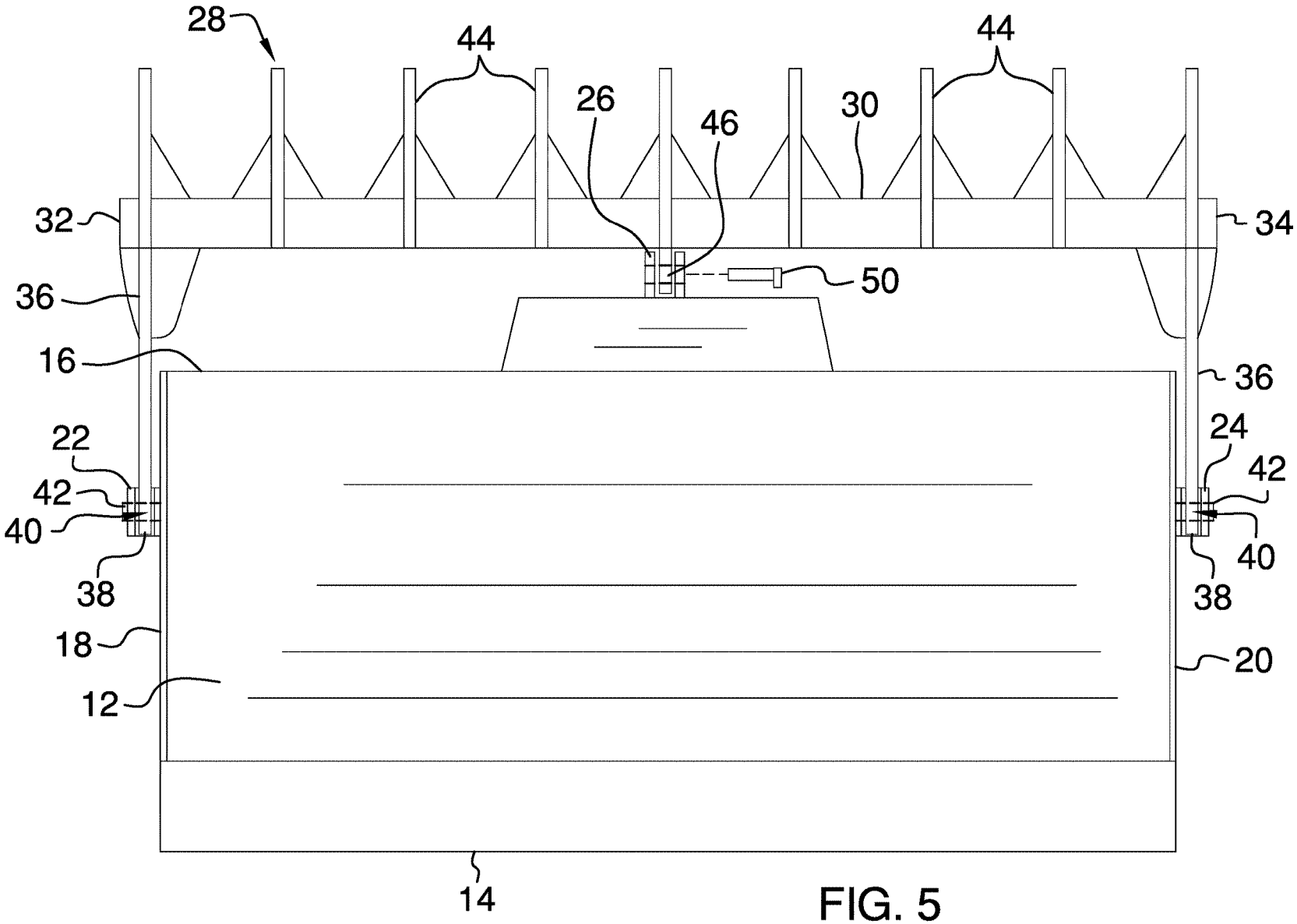
FIG. 5 is a front view of an embodiment of the disclosure showing a rake unit in a stored position.
Figure 6:
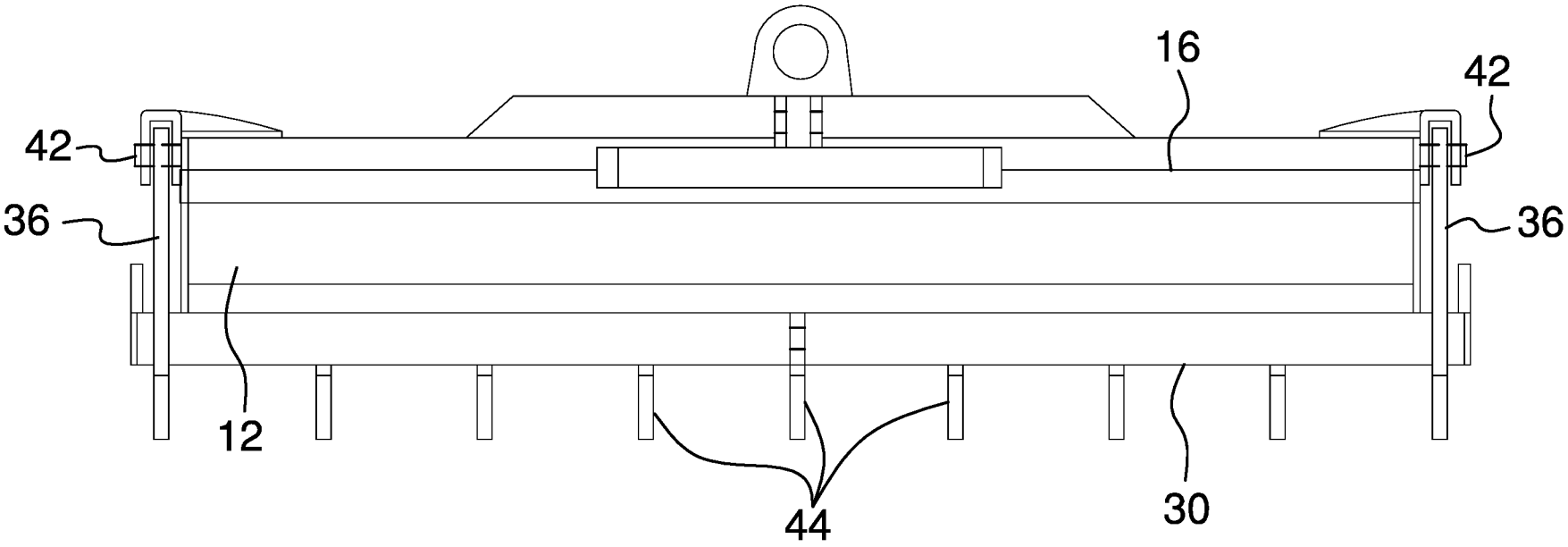
FIG. 6 is a top view of an embodiment of the disclosure.

With reference now to the drawings, and in particular to FIGS. 1 through 6 thereof, a new rake device embodying the principles and concepts of an embodiment of the disclosure and generally designated by the reference numeral 10 will be described.

As best illustrated in FIGS. 1 through 6, the bulldozer rake assembly 10 generally comprises a bulldozer blade 12 that is mountable on a bulldozer for grading. The bulldozer blade 12 may be a bulldozer blade 12 of any conventional size and design. Additionally, the bulldozer may be a motorized bulldozer of any conventional size and design. The bulldozer blade 12 has a bottom edge 14, a top edge 16, a first lateral edge 18 and a second lateral edge 20.

A first pivot 22 is coupled to the bulldozer blade 12, the first pivot 22 is positioned on the first lateral edge 18 of the bulldozer blade 12 and the first pivot 22 is positioned closer to the top edge 16 than the bottom edge 14. A second pivot 24 is coupled to the bulldozer blade 12, the second pivot 24 is positioned on the second lateral edge 20 of the bulldozer blade 12 and the second pivot 24 is positioned closer to the top edge 16 than the bottom edge 14. A stop 26 is coupled to the bulldozer blade 12 and the stop 26 is positioned on the top edge 16 and the stop 26 is centrally positioned between the first 18 and second 20 lateral edges. Additionally, each of the first 22 and second 24 pivots and the stop 26 may comprise a pair of plates that are spaced apart from each other that each has an aperture extending therethrough.

A rake unit 28 is provided and the rake unit 28 is pivotally coupled to the bulldozer blade 12. The rake unit 28 is positionable in a deployed position having the rake unit 28 being aligned with the bottom edge 14 of the bulldozer blade 12. The rake unit 28 engages roots and debris for grubbing when the rake unit 28 is in the deployed position. The rake unit 28 is positionable in a stored position having the rake unit 28 being aligned with the top edge 16 of the bulldozer blade 12. In this way the bulldozer blade 12 can be employed to engage earth for grading.

The rake unit 28 comprises a member 30 that has a first end 32 and a second end 34, and the member 30 is elongated between the first 32 and second 34 ends. A pair of arms 36 is provided and each of the arms 36 is coupled to a respective one of the first 32 and second 34 ends of the member 30. Each of the arms 36 is oriented perpendicular to an axis extending through the first 32 and second 34 ends of the member 30 and each of the arms 36 has a distal end 38 with respect to the member 30. Each of the arms 36 has an aperture 40 extending therethrough and is associated therewith and the aperture 40 is aligned with the distal end 38 of the associated arm 36. The distal end 38 of each of the arms 36 engages a respective one of the first 22 and second 24 pivots on the bulldozer blade 12.

A pair of mounting pins 42 is provided and each of the mounting pins 42 extends through a respective one of the first 22 and second 24 pivots and engages the aperture 40 in a respective one of the arms 36. In this way each of the arms 36 is pivotally coupled to the respective first 22 and second 24 pivot. The member 30 is aligned with and is coextensive with the bottom edge 14 of the bulldozer blade 12 when the rake unit 28 is positioned in the deployed position. Alternatively, the member 30 is spaced upwardly from and is coextensive with the top edge 16 of the bulldozer blade 12 when the rake unit 28 is positioned in the stored position.

A plurality of tines 44 is each coupled to and extends away from the member 30. The tines 44 are spaced apart from each other and are distributed between the first 32 and second 34 ends of the member 30. Each of the tines 44 is oriented perpendicular to an axis extending between the first 32 and second 34 ends. Each of the tines 44 extends downwardly from the member 30 when the rake unit 28 is positioned in the deployed position to engage earth for grubbing. Additionally, each of the tines 44 is directed upwardly from the member 30 when the rake unit 28 is positioned in the stored position.

A receiver 46 is coupled to and extends away from the member 30 and the receiver 46 is centrally positioned between the first 32 and second 34 ends. The receiver 46 has a hole 48 extending therethrough and the receiver 46 engages the stop 26 when the rake unit 28 is positioned in the stored position. A stop pin 50 is extendable through the hole in the receiver 46 and engages the stop 26 when the rake unit 28 is positioned in the stored position for retaining the rake unit 28 in the stored position.

A pair of restraints 52 is each coupled to a respective one of the first 32 and second 34 ends of the member 30. Each of the restraints 52 abuts a respective one of the first 18 and second 20 lateral edges of the bulldozer blade 14 when the rake unit 28 is positioned in the deployed position. In this way the restraints 52 inhibits the rake unit 28 from deflecting laterally when the tines 44 engage earth during grubbing.

In use, the rake unit 28 is positioned in the stored position and the stop pin 50 is extended through the receiver 46 and the stop 26 to retain the rake unit 28 in the stored position. Thus, the bottom edge 14 of the bulldozer blade 12 is exposed for the purposes of grading. The stop pin 50 is removed from the receiver 46 and the stop 26 thereby facilitating the rake unit 28 to be lowered into the deployed position. Thus, the tines 44 extend downwardly from the bottom edge 14 of the bulldozer blade 12 for the purposes of grubbing. Additionally, the member 30 abuts the bulldozer blade 12 when the rake unit 28 is in the deployed position thereby inhibiting the rake unit 28 from being urged rearwardly during grubbing. In this way a single bulldozer blade 12 can be employed for both grubbing and grading.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bulldozer rake assembly having a rake being pivotally coupled to a bulldozer blade wherein said assembly is configured to both rake and grade, said assembly comprising:

a bulldozer blade being mountable on a bulldozer for grading, said bulldozer blade having a bottom edge, a top edge, a first lateral edge and a second lateral edge;

a rake unit being pivotally coupled to said bulldozer blade, said rake unit being positionable in a deployed position having said rake unit being aligned with said bottom edge of said bulldozer blade wherein said rake unit is configured to engage roots and debris for grubbing, said rake unit being positionable in a stored position having said rake unit being aligned with said top edge of said bulldozer blade wherein said bulldozer blade is configured to engage earth for grading;

a first pivot being coupled to said bulldozer blade, said first pivot being positioned on said first lateral edge of said bulldozer blade, said first pivot being positioned closer to said top edge than said bottom edge;

a second pivot being coupled to said bulldozer blade, said second pivot being positioned on said second lateral edge of said bulldozer blade, said second pivot being positioned closer to said top edge than said bottom edge;

a stop being coupled to said bulldozer blade, said stop being positioned on said top edge, said stop being centrally positioned between said first and second lateral edges; and said rake unit comprising a member having a first end and a second end, said member being elongated between said first and second ends, a pair of arms, each of said arms being coupled to a respective one of said first and second ends of said member, each of said arms being oriented perpendicular to an axis extending through said first and second ends of said member, each of said arms having a distal end with respect to said member, and each of said arms having an aperture extending therethrough and being associated therewith, said aperture being aligned with said distal end of said associated arm, said distal end of each of said arms engaging a respective one of said first and second pivots on said bulldozer blade.

2. The assembly according to claim 1, further comprising a pair of mounting pins, each of said mounting pins extending through a respective one of said first and second pivots and engaging said aperture in a respective one of said arms such that each of said arms is pivotally coupled to said respective first and second pivot, said member being aligned with said bottom edge of said bulldozer blade when said rake unit is positioned in said deployed position, said member being spaced upwardly from said top edge of said bulldozer blade when said rake unit is positioned in said stored position.

3. The assembly according to claim 2, further comprising a plurality of tines, each of said tines being coupled to and extending away from said member, said tines being spaced apart from each other and being distributed between said first and second ends of said member, each of said tines being oriented perpendicular to an axis extending between said first and second ends, each of said tines extending downwardly from said member when said rake unit is positioned in said deployed position wherein each of said tines is configured to engage earth for grubbing, each of said tines being directed upwardly from said member when said rake unit is positioned in said stored position.

4. The assembly according to claim 1, further comprising a receiver being coupled to and extending away from said member, said receiver being centrally positioned between said first and second ends, said receiver having a hole extending therethrough, said receiver engaging said stop when said rake unit is positioned in said stored position.

5. The assembly according to claim 4, further comprising a stop pin being extendable through said hole in said receiver and engaging said stop when said rake unit is positioned in said stored position for retaining said rake unit in said stored position.

6. A bulldozer rake assembly having a rake being pivotally coupled to a bulldozer blade wherein said assembly is configured to both rake and grade, said assembly comprising:

a bulldozer blade being mountable on a bulldozer for grading, said bulldozer blade having a bottom edge, a top edge, a first lateral edge and a second lateral edge;

a first pivot being coupled to said bulldozer blade, said first pivot being positioned on said first lateral edge of said bulldozer blade, said first pivot being positioned closer to said top edge than said bottom edge;

a second pivot being coupled to said bulldozer blade, said second pivot being positioned on said second lateral edge of said bulldozer blade, said second pivot being positioned closer to said top edge than said bottom edge;

a stop being coupled to said bulldozer blade, said stop being positioned on said top edge, said stop being centrally positioned between said first and second lateral edges; and a rake unit being pivotally coupled to said bulldozer blade, said rake unit being positionable in a deployed position having said rake unit being aligned with said bottom edge of said bulldozer blade wherein said rake unit is configured to engage roots and debris for grubbing, said rake unit being positionable in a stored position having said rake unit being aligned with said top edge of said bulldozer blade wherein said bulldozer blade is configured to engage earth for grading, said rake unit comprising:

a member having a first end and a second end, said member being elongated between said first and second ends;

a pair of arms, each of said arms being coupled to a respective one of said first and second ends of said member, each of said arms being oriented perpendicular to an axis extending through said first and second ends of said member, each of said arms having a distal end with respect to said member, each of said arms having an aperture extending therethrough and being associated therewith, said aperture being aligned with said distal end of said associated arm, said distal end of each of said arms engaging a respective one of said first and second pivots on said bulldozer blade;

a pair of mounting pins, each of said mounting pins extending through a respective one of said first and second pivots and engaging said aperture in a respective one of said arms such that each of said arms is pivotally coupled to said respective first and second pivot, said member being aligned with said bottom edge of said bulldozer blade when said rake unit is positioned in said deployed position, said member being spaced upwardly from said top edge of said bulldozer blade when said rake unit is positioned in said stored position;

a plurality of tines, each of said tines being coupled to and extending away from said member, said tines being spaced apart from each other and being distributed between said first and second ends of said member, each of said tines being oriented perpendicular to an axis extending between said first and second ends, each of said tines extending downwardly from said member when said rake unit is positioned in said deployed position wherein each of said tines is configured to engage earth for grubbing, each of said tines being directed upwardly from said member when said rake unit is positioned in said stored position;

a receiver being coupled to and extending away from said member, said receiver being centrally positioned between said first and second ends, said receiver having a hole extending therethrough, said receiver engaging said stop when said rake unit is positioned in said stored position; and a stop pin being extendable through said hole in said receiver and engaging said stop when said rake unit is positioned in said stored position for retaining said rake unit in said stored position.

* * * * *